US005702259A

United States Patent [19]

Lee

[11] Patent Number: 5,702,259

[45] Date of Patent: Dec. 30, 1997

[54] SAFETY SOCKET AND PLUG ARRANGEMENT

[76] Inventor: Chiu-Shan Lee, No. 4, Alley 14, Lane 53, Hung-Tao St., Hsi-Chih Town, Taipei County, Taiwan

[21] Appl. No.: 695,594

[22] Filed: Aug. 12, 1996

[51] Int. Cl.[6] ..... H01R 13/453

[52] U.S. Cl. ..... 439/137; 439/145; 439/172; 439/518

[58] Field of Search ..... 439/137, 145, 439/139; 220/242

[56] References Cited

U.S. PATENT DOCUMENTS 4,867,694 9/1989 Short ..... 439/145

5,011,419 4/1991 Maan ..... 439/139

5,267,870 12/1993 Maresh ..... 439/137

5,624,270 4/1997 Blanchot et al. ..... 439/145

*Primary Examiner*—P. Austin Bradley

*Attorney, Agent, or Firm*—Morton J. Rosenberg; David I. Klein; Jun Y. Lee

[57] ABSTRACT

A safety socket and plug arrangement in which the socket has a spring-supported safety baffle plate blocking in the plug blade insertion slots, the safety baffle plate being moved out of the plug blade insertion slots when the metal contact blades of an electric plug are inserted into the plug blade insertion slots, or tilted and stopped in place when a child inserts a rod member into one plug blade insertion slot; the plug includes a plug shell and a replaceable plug head detachably coupled to the plug shell for connection to an electric socket.

10 Claims, 10 Drawing Sheets

SAFETY SOCKET AND PLUG ARRANGEMENT

BACKGROUND OF THE INVENTION

The present invention relates to a safety socket and plug arrangement in which the socket has a safety baffle plate turned about a sliding rod and forced by spring to block up the plug blade insertion holes. The safety baffle plate is moved backwards when the metal contact blades of an electric plug are inserted into the plug blade insertion slots of the socket, for permitting the metal contact blades of the electric plug to contact the electric terminals. The safety baffle plate is tilted and stopped in place to block up the plug blade insertion slots when a child inserts a rod member into one plug blade insertion slot.

Various electric sockets and electric plugs have been disclosed, and have appeared on the market. However, regular electric sockets cannot protect the electric terminals from being touched by an object being inserted by a child. Therefore, an electric shock tends to occur when a child inserts a metal object into an electric socket. Furthermore, regular electric plugs are commonly of fixed type specifically designed to fit a particular specification of electric socket. Therefore, different electric plugs must be used with different electric sockets.

SUMMARY OF THE INVENTION

It is one object of the present invention to provide an electric socket which is safe in use. It is another object of the present invention to provide an electric plug which has a detachable plug head that can be replaced to fit any of a variety of electric sockets. According to one embodiment of the present invention, the safety socket and plug arrangement comprises a socket unit and a plug unit. The socket unit comprises a baffle holder having a horizontal sliding rod and two recessed portions equally spaced from the horizontal sliding rod at two opposite sides, a safety baffle plate turned about and moved along the horizontal sliding rod, and two spring elements bilaterally connected between the baffle holder and the safety baffle plate to impart a forward pressure to the safety baffle plate. The safety baffle plate comprises a center axle hole which receives the horizontal sliding rod of the baffle holder, two first top slopes disposed at two opposite sides, two second top slopes disposed at two opposite sides between the center axle hole and the first top slopes at a lower elevation than the first top slopes, each of the first top slopes having a top end terminating in a top flange. The safety baffle plate is forced forwards by the spring elements to block up the electric terminals from the plug blade insertion slots of the socket unit, or moved backwards to compress the spring elements upon the insertion of the metal contact blades of an electric plug into the plug blade insertion slots, for permitting the metal contact blades of the inserted electric plug to make contact with the electric terminals of the socket unit. The safety baffle plate is tilted to force the top flange of one of the first top slopes into engagement with one recessed portion of the baffle holder, and prohibited from backward movement when a rod member is inserted through one plug blade insertion slot of the socket unit and pressed on one of the top slopes. The plug unit comprises a plug shell and a plug head. The plug shell comprises a circular open chamber at the back side adapted for receiving the plug head, a plurality of locating grooves of different sizes spaced on the inside around the circular open chamber, a plurality of electric terminals, and a coupling portion disposed inside the circular open chamber. The plug head fits the circular open chamber, comprising a plurality of metal contact blades adapted for connecting to an electric socket, a plurality of locating tabs of different sizes spaced around the periphery and adapted for fastening to the locating grooves of the plug shell through a rotary motion, and a coupling portion adapted for coupling to the coupling portion of the plug shell. The metal contact blades of the plug head are respectively forced into contact with the electric terminals of the plug shell when the plug head is installed in the plug hole of the plug shell.

DETAILED DESCRIPTION OF THE PREFERRED EMBODIMENT

Figure 1:
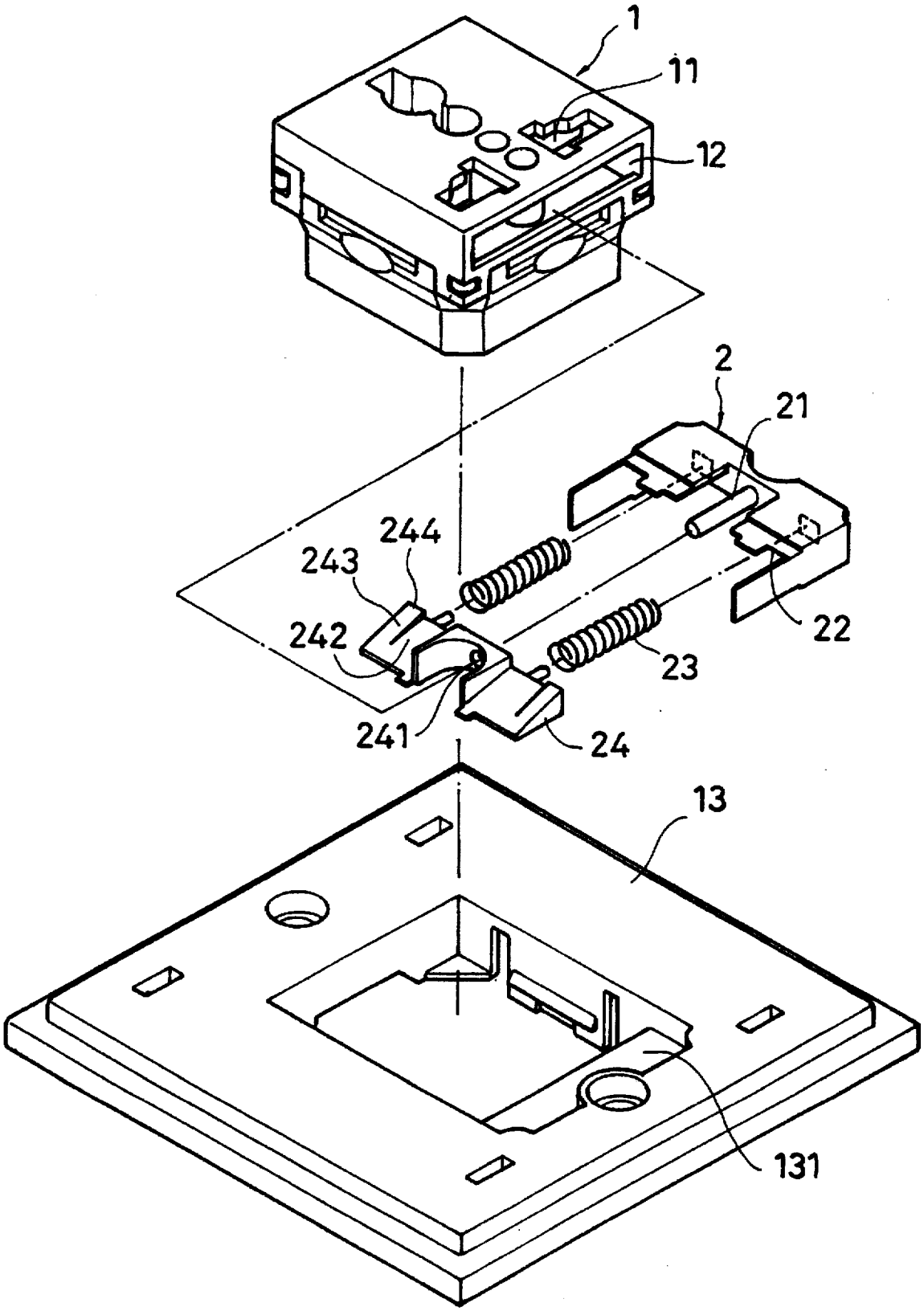
FIG. 1 is an exploded view of an electric socket according to the present invention.
Figure 2:
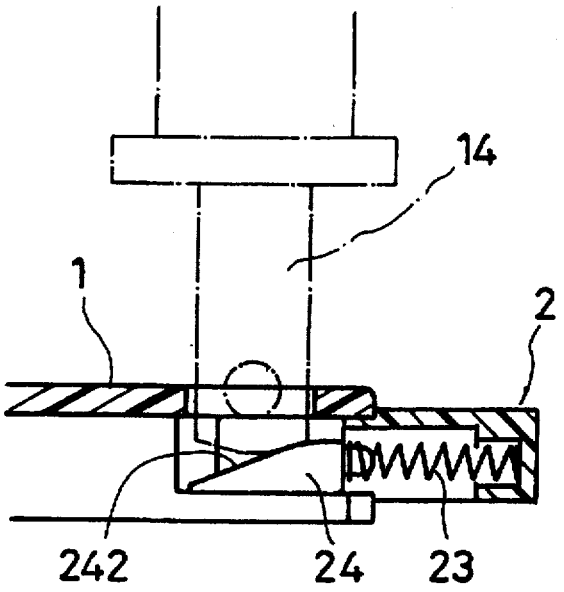
FIG. 2 is a sectional view of the electric socket shown in FIG. 1, showing the metal contact blades of an electric plug inserted into the slots of the electric socket, and the safety baffle plate forced outwards.
Figure 3:
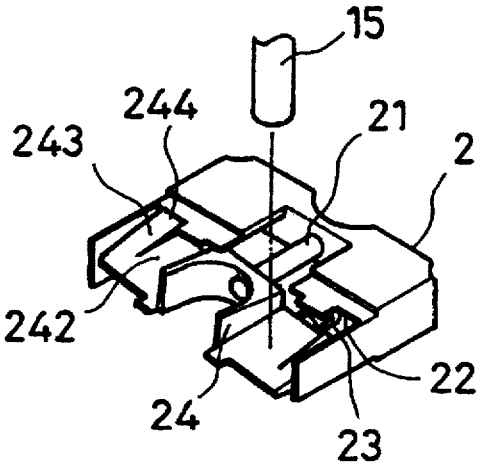
FIG. 3 is an elevational view of the baffle holder shown in FIG. 1.
Figure 3A:
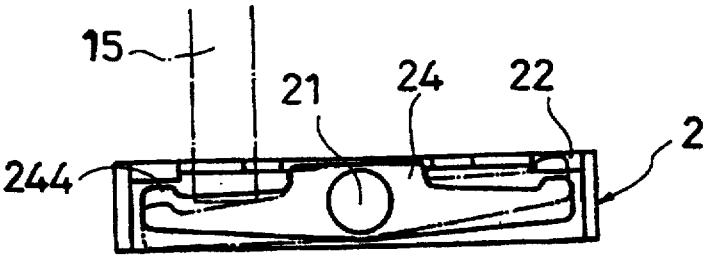
FIG. 3A is an end view of FIG. 3.

Referring to FIGS. 1, 2, 3, and 3A, a baffle holder 2 is mounted in a transverse hole 12 in the socket body 1 and supported on a recessed portion 131 in the wall mount 13. The baffle holder 2 has a sliding rod 21 horizontally disposed in the middle. A safety baffle plate 24 is mounted on the baffle holder 2 and moved along the sliding rod 21. Two springs 23 are bilaterally connected between the baffle holder 2 and the safety baffle plate 24 to impart an outward pressure to the safety baffle plate 24. The safety baffle plate 24 comprises a center axle hole 241 which receives the sliding rod 21, two first top slopes 243 disposed at two opposite sides and sloping in the same direction, two second top slopes 242 disposed at two opposite sides between the center axle hole 241 and the first top slopes 243 at a lower elevation than the first top slopes 243. The first top slopes 243 have a respective top end terminating in a respective top flange 244. The baffle holder 2 has two recessed portions 22 adapted for receiving the top flanges 244 of the first top slopes 243 when the safety baffle plate 24 is tilted. When assembled, the safety baffle plate 24 is forced inwards by the springs 23 to block up the slots 11 of the socket body 1. When the metal contact blades 14 of an electric plug are inserted into the slots 11 of the socket body 1, the metal contact blades 14 are forced downwards against the first top slopes 243 or the second top slopes 242 (subject to the type of the metal contact blades 14), thereby causing the safety baffle plate 24 to be moved outwards toward the baffle holder 2. When the safety baffle plate 24 is moved outwards, the metal contact blades 14 are allowed to be moved into contact with the neutral and hot terminals of the socket body 1, and at the same time, the springs 23 are compressed. When the metal contact blades 14 of the electric plug are removed from the slots 11 of the socket body 1, the springs 23 automatically push the safety baffle plate 24 back to its former position. If a child inserting a rod member 15 into one slot 11 of the socket body 1, the safety baffle plate 24 will be forced to turn about the sliding rod 21 of the baffle holder 2, causing the top flange 244 of one first top slope 243 to be forced into engagement with the corresponding recessed portion 22 of the sliding rod 21 (see FIGS. 3 and 3A). Therefore, the safety baffle plate 24 is prohibited from backward movement.

Figure 4:
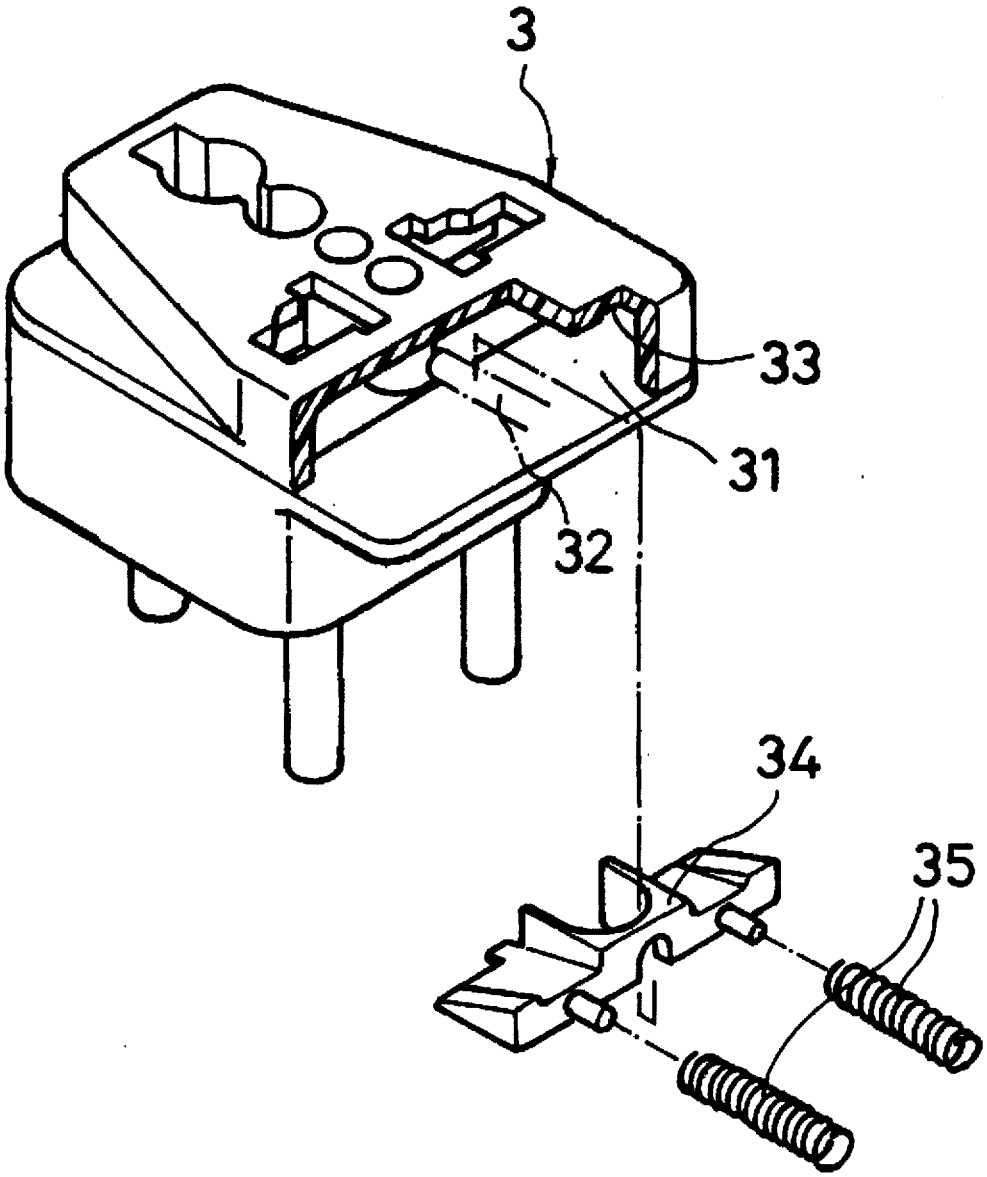
FIG. 4 is a sectional view of the electric socket shown in FIG. 1, showing a rod member inserted into one slot of the electric socket and pressed against the safety baffle plate, and the safety baffle plate tilted.

Referring to FIG. 4, the electric socket 3 comprises a receiving chamber 31 on the inside, a sliding rod 32 horizontally projecting into the receiving chamber 31, two recessed portions 33 bilaterally and downwardly disposed inside the receiving chamber 31, a safety baffle plate 34 sliding on the sliding rod 32, and two springs 35 bilaterally mounted inside the receiving chamber 31 to impart a forward pressure to the safety baffle plate 34. The recessed portions 33 are adapted for stopping the safety baffle plate 34 from backward movement when the safety baffle plate 34 is tilted by an object being inserted into the electric socket 3.

Referring to FIGS. 5, 5A, 5B, and 5C, the plug shell, referenced by 4, comprises a circular open chamber 41 at the back adapted for receiving a plug head 5, a plurality of locating grooves 42 of different sizes spaced on the inside around the circular open chamber 41, a plurality of electric terminals 43, and a coupling portion 44 disposed inside the circular open chamber 41 at a suitable location. The plug head 5 fits the circular open chamber 41, comprising a plurality of metal contact blades 51 adapted for connecting to an electric socket, a plurality of locating tabs 52 of different sizes spaced around the periphery and adapted for fastening to the locating grooves 42 through a rotary motion, and a coupling portion 53 adapted for coupling to the coupling portion 44 of the plug shell 4. When the plug head 5 is inserted into the circular open chamber 41 of the plug shell 4 and turned through an angle to force the mounting tabs 52 into engagement with the locating grooves 42, the metal contact blades 51 of the plug head 5 are respectively forced into contact with the electric terminals 43 of the plug shell 4, and the coupling portion 53 of the plug head 5 is forced into engagement with the coupling portion 44 of the plug shell 4. This design allows different plug heads having metal contact blades of different specifications to be alternatively fastened to the plug shell to fit different electric sockets.

Figure 5:
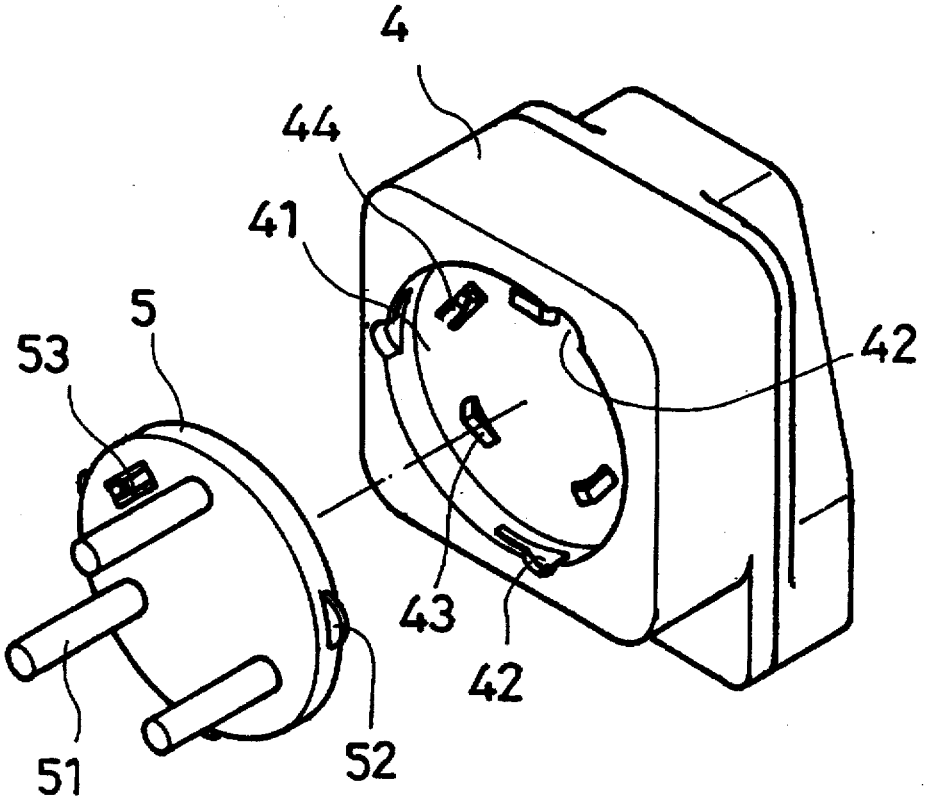
FIG. 5 is an exploded view of an electric plug according to the present invention.
Figure 5A:
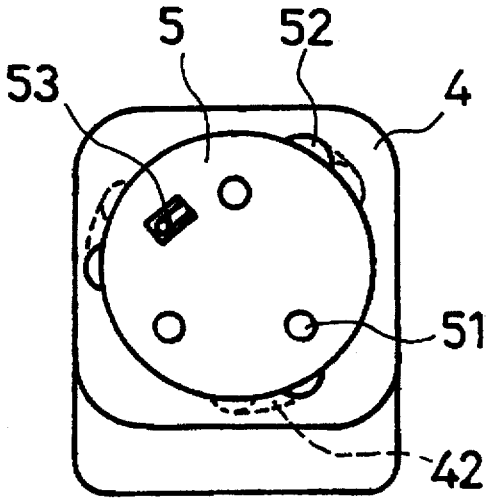
FIG. 5A is a front view of the electric plug shown in FIG. 5, showing the positioning of the tabs of the blade holder in the locating grooves of the plug shell.
Figure 5B:
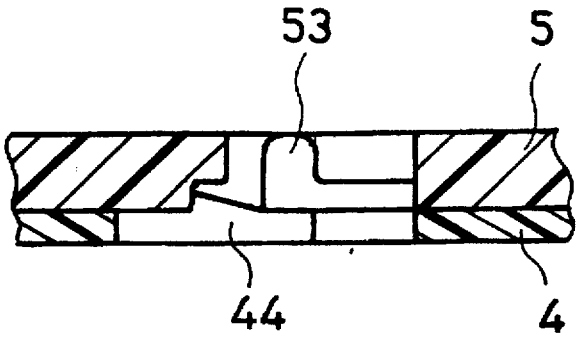
FIG. 5B is a sectional view of a part of FIG. 5-1, showing the connection between the coupling portion of the plug shell and the coupling portion of the blade holder.
Figure 5C:
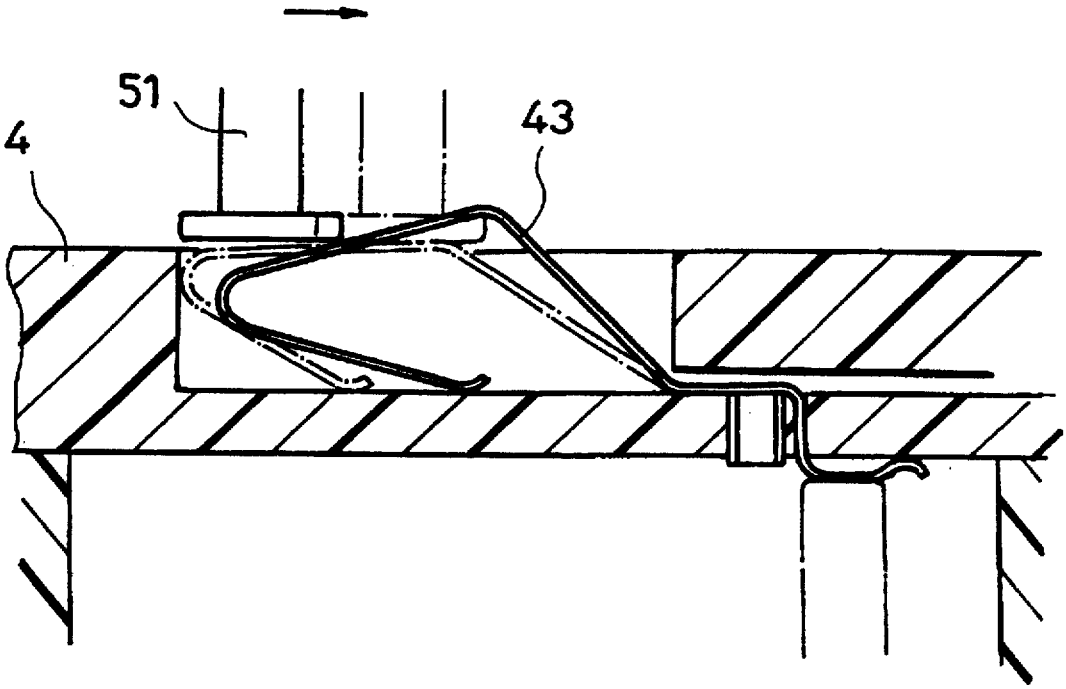
FIG. 5C is an enlarged view showing an electric terminal.
Figure 6:
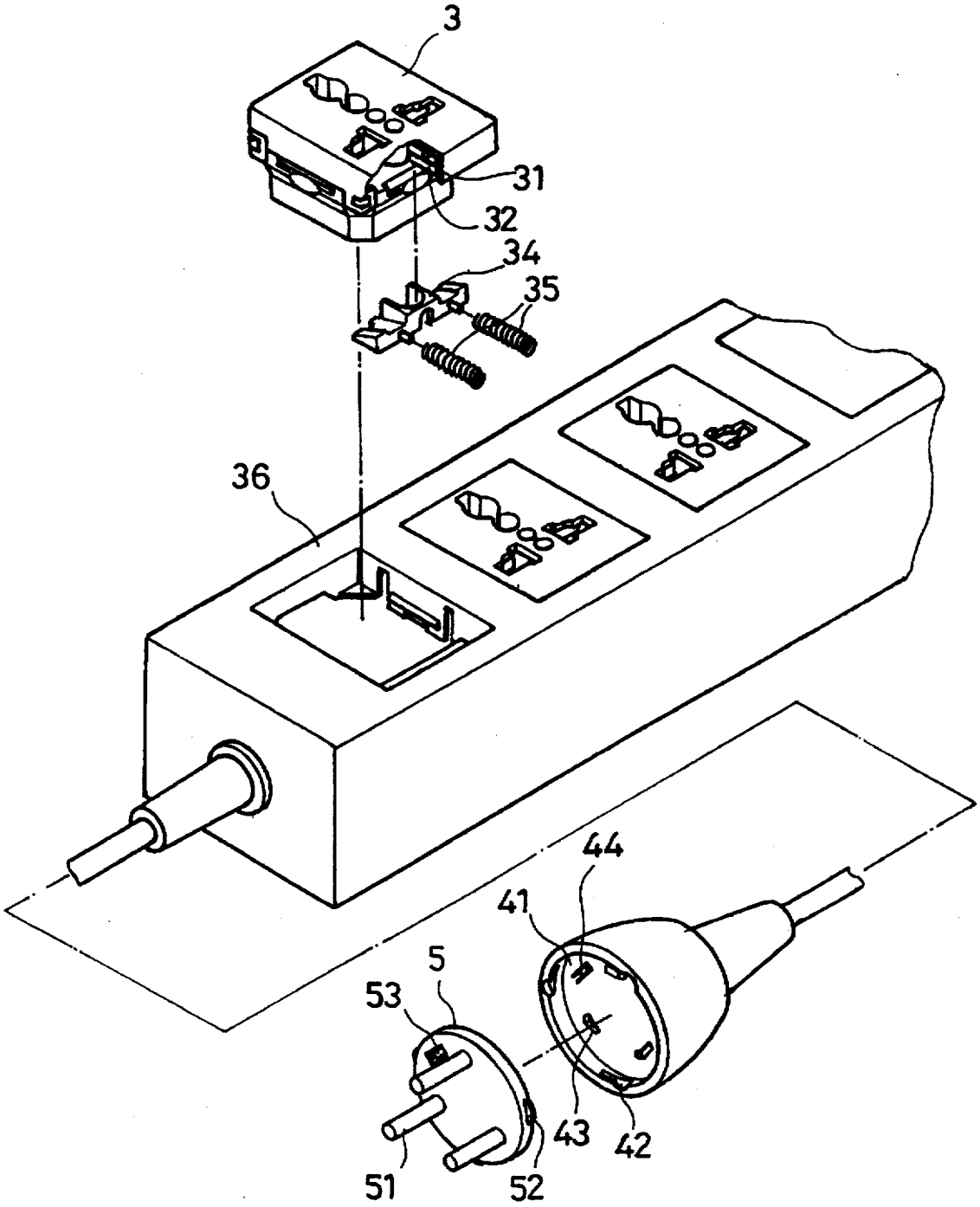
FIG. 6 is an exploded view of an electric extension line according to the present invention.

FIG. 6 shows an electric extension line made according to the present invention, having a socket holder 36 at one end holding a plurality of electric sockets 3, which is made according to the embodiment shown in FIG. 4, and an electric plug at an opposite end, which is made according to the embodiment shown in FIG. 5.

Figure 7:
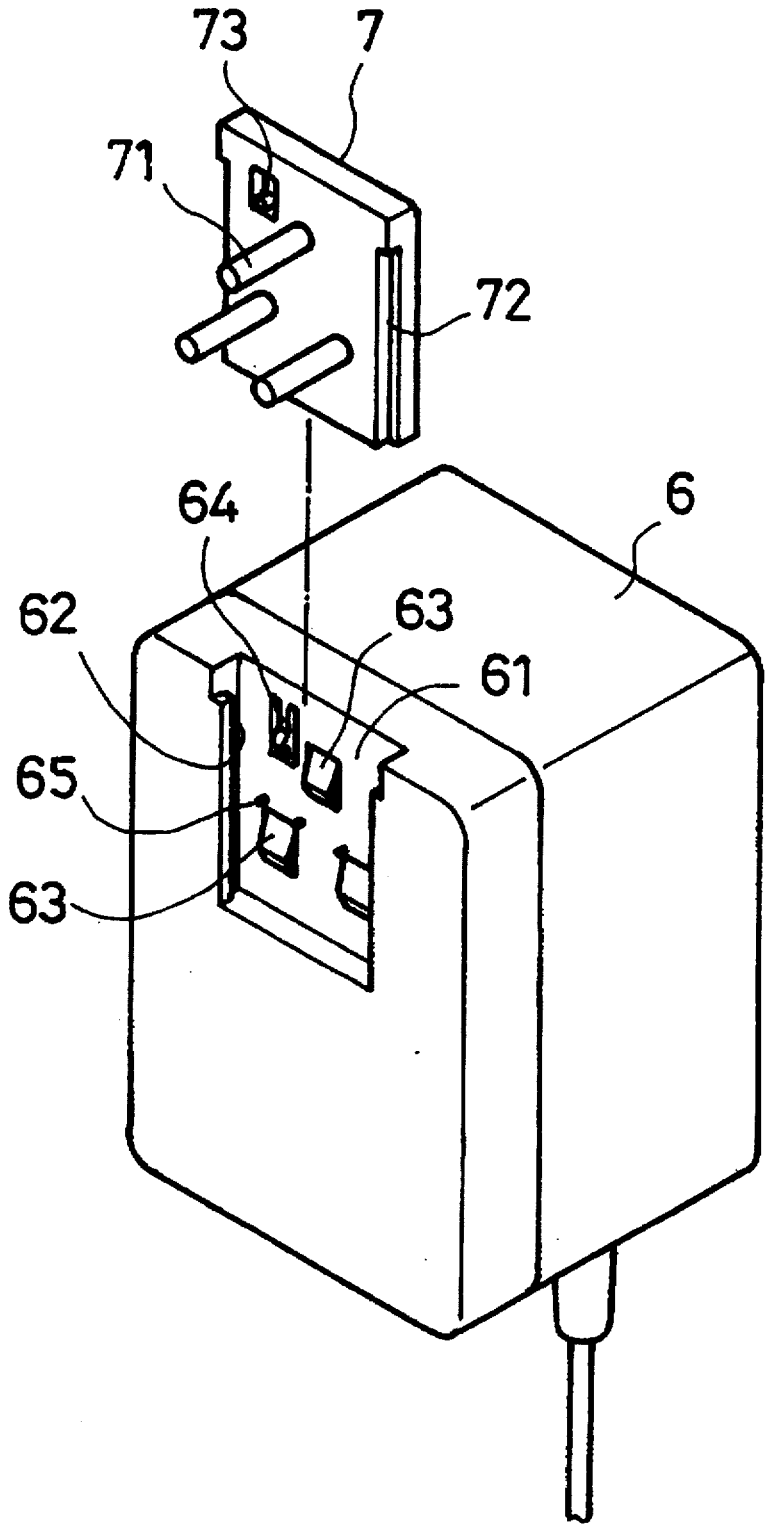
FIG. 7 is an exploded view of a transformer according to the present invention.

Referring to FIG. 7, a plug head 7 is detachably fastened to a transformer 6, and adapted for connecting the transformer 6 to an electric socket. The transformer 6 comprises a back recess 61 extending to the border and adapted for receiving the plug head 7, two longitudinal sliding grooves 62 at two opposite sides of the back recess 61, a plurality of electric terminals 63 mounted in the back recess 61 and connected to the internal electric circuit, a coupling portion 64, and a plurality of upright stub rods 65 disposed in the back recess 61. The plug head 7 comprises two sliding rails 72 at two opposite sides adapted for inserting into the sliding grooves 62 of the transformer 6, a plurality of metal contact blades 71 adapted for inserting into respective slots of an electric socket, and a coupling portion 73 adapted for coupling the coupling portion 64 of the transformer 6. When the sliding rails 72 of the plug head 7 is inserted into the sliding grooves 62 of the transformer 6, the coupling portion 73 of the plug head 7 is forced into engagement with the coupling portion 64 of the transformer 6, and the metal contact blades 71 are respectively forced into contact with the electric terminals 63 of the transformer 6.

Figure 8:
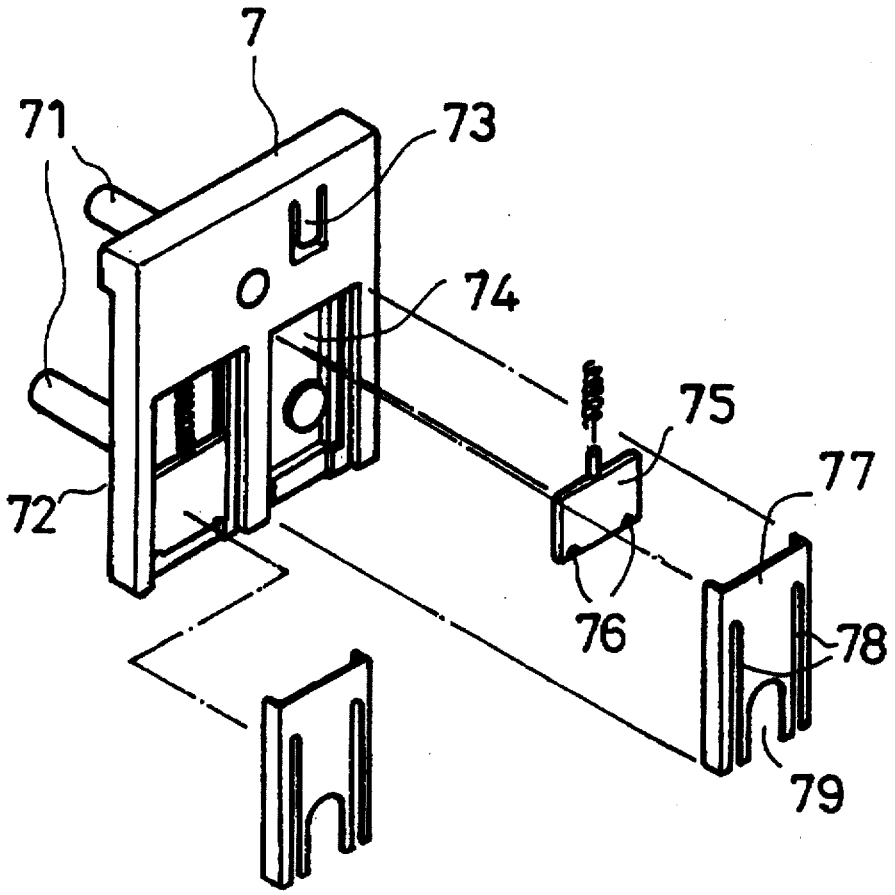
FIG. 8 is an exploded view in an enlarged scale of the plug head of the transformer shown in FIG. 7.
Figure 8A:
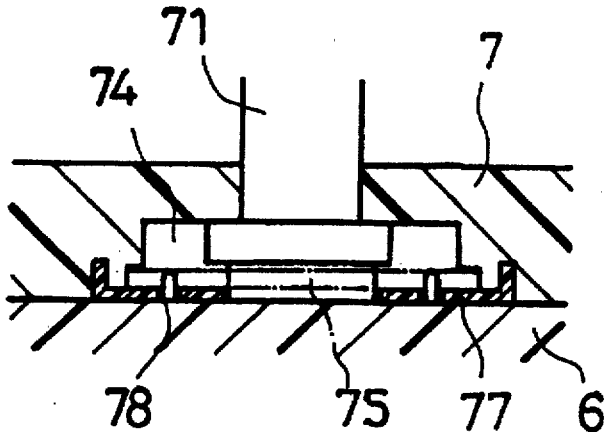
FIG. 8A is a sectional view of the transformer shown in FIG. 7, showing the baffle plate stopped between the metal contact blade and the electric terminal.

Referring to FIGS. 8 and 8A, the plug head 7 shown in FIG. 7 further comprises two downward back troughs 74, two spring-supported baffle plates 75 respectively mounted in the back troughs 74, and two covers 77 respectively covered on the back troughs 74. Each of the covers 77 has two downward sliding slots 78, and a bottom opening 79 between the downward sliding slots 78. Each of the spring-supported baffle plates 75 has two bottom notches 76 corresponding to the downward sliding slots 78 of the corresponding cover 77. When the plug head 7 is installed in the back recess 61 of the transformer 6, the stub rods 65 of the transformer 6 are forced into the sliding slots 78 of the covers 77 into engagement with the bottom notches 76, causing the baffle plates 75 to be lifted upwards, for permitting the metal contact blades 71 of the plug head 7 to be forced into contact with the electric terminals 63 of the transformer 6.

Figure 8B:
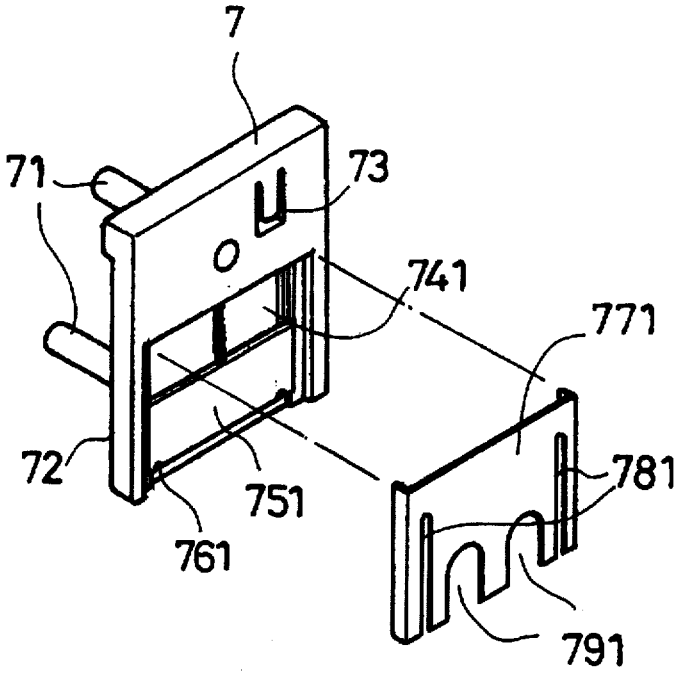
FIG. 8B is an exploded view of an alternate form of the plug head for the transformer shown in FIG. 7.

Referring to FIG. 8B, the plug head 7 may be made having one back trough 741 adapted for receiving one spring-supported baffle plate 751, which has two bottom notches 761; and covered with a cover 771, which has two downward sliding slots 781 and two bottom openings 791 spaced between the downward sliding slots 781. This alternate form acts in the same manner as that shown in FIGS. 7 and 8.

Figure 9:
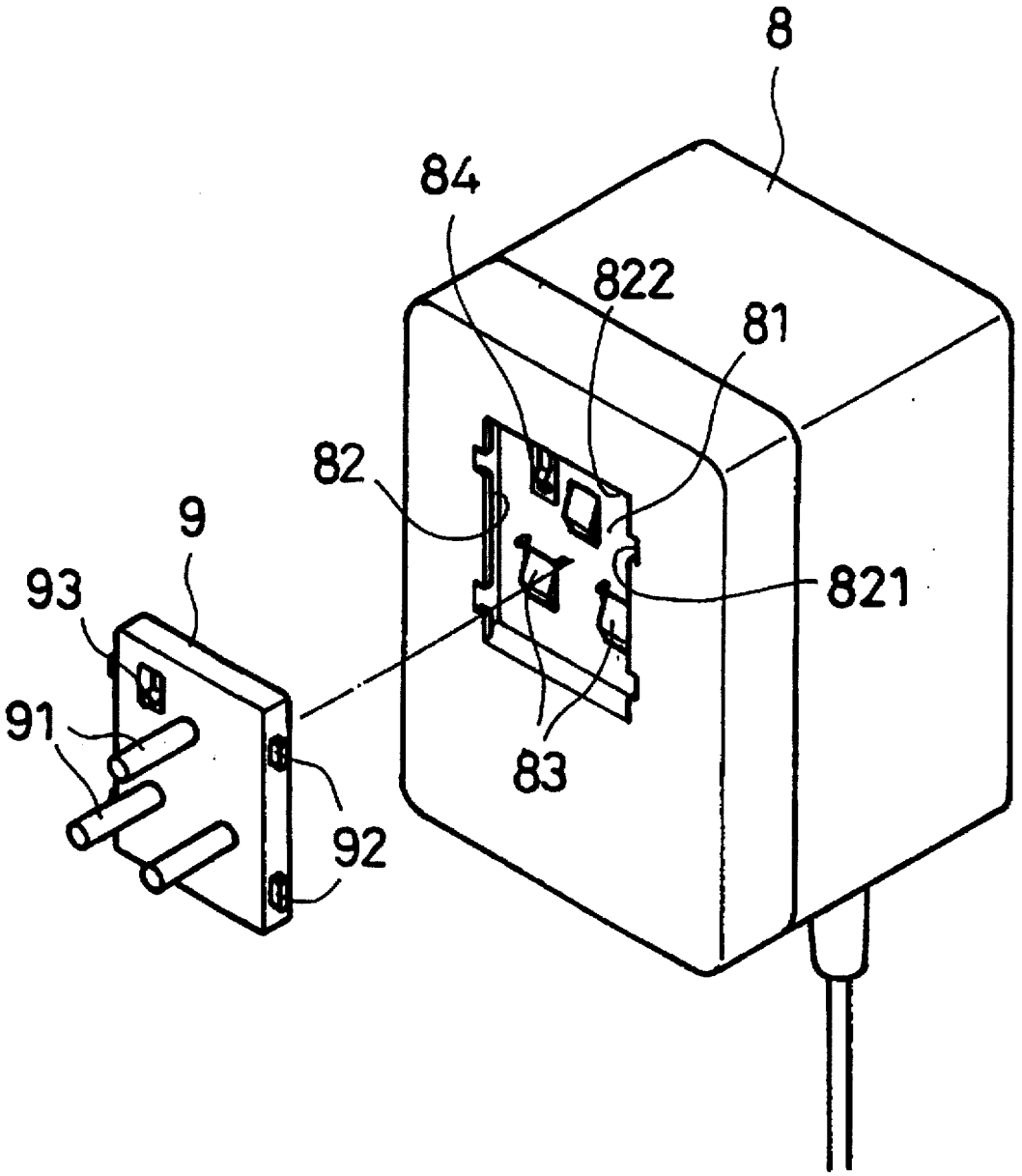
FIG. 9 is an exploded view of an alternate form of the transformer according to the present invention.

Referring to FIG. 9, a plug head 9 is detachably fastened to a transformer 8, and adapted for connecting the transformer 8 to an electric socket. The transformer 8 comprises a recessed back hole 81 adapted for receiving the plug head 9, two longitudinal sliding grooves 82 at two opposite sides of the recessed back hole 81, a plurality of electric terminals 83 mounted in the recessed back hole 81 and connected to the internal electric circuit, a coupling portion 84, pairs of vertically spaced notches 821 respectively disposed in communication with the longitudinal sliding grooves 82, and a transverse locating groove 822 connected between the longitudinal sliding grooves 82 at the top. The plug head 9 comprises pairs of mounting tabs 92 adapted for inserting through the notches 821 into the longitudinal sliding grooves 82, a plurality of metal contact blades 91 adapted for inserting into corresponding slots in an electric socket to make electric contact with respective electric terminals, and a coupling portion 93 adapted for coupling to the coupling portion 84 of the transformer 8. When the mounting tabs 92 of the plug head 9 are inserted through the notches 821 into the longitudinal sliding grooves 82, the plug head 9 is pushed upwards into engagement with the transverse locating groove 822, thereby causing the coupling portion 93 of the plug head 9 to be forced into engagement with the coupling portion 84 of the transformer 8 and the metal contact blades 91 to be forced into contact with the electric terminals 83.

Figure 10:
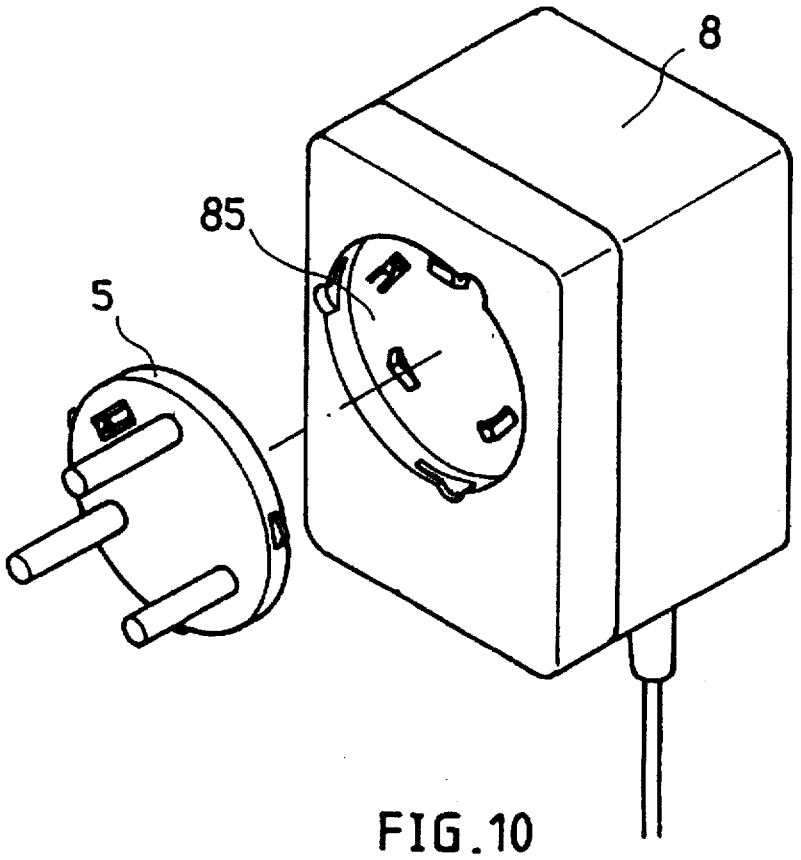
FIG. 10 is an exploded view of another alternate form of the transformer according to the present invention.

FIG. 10 shows another alternate form of the transformer 8. According to this alternate form, the transformer 8 has a plug hole 85 at the back side adapted for receiving a plug head 5. The structure of the plug hole 85 is similar to the plug hole 44 of the plug shell 4 shown in FIG. 5, and the plug head 5 is identical to that shown in FIG. 5.

It is to be understood that the drawings are designed for purposes of illustration only, and are not intended as a definition or limits of the scope of the invention disclosed.

What the invention claimed is:

1. A safety socket and plug arrangement comprising a socket unit for the connection of an electric plug, and a plug unit for connection to an electric socket, said socket unit comprising a plurality of slots in a front side thereof adapted for receiving the metal contact blades of an electric plug, and a plurality of electric terminals disposed in said slots, wherein: said socket unit comprises a baffle holder having a horizontal sliding rod and two recessed portions equally spaced from said horizontal sliding rod at two opposite sides, a safety baffle plate turned about and moved along said horizontal sliding rod, and two spring elements bilaterally connected between said baffle holder and said safety baffle plate to impart a forward pressure to said safety baffle plate, said safety baffle plate comprising a center axle hole which receives said horizontal sliding rod, two first top slopes disposed at two opposite sides, two second top slopes disposed at two opposite sides between said center axle hole and said first top slopes at a lower elevation than said first top slopes, each of said first top slopes having a top end terminating in a top flange, said safety baffle plate being forced forwards by said spring elements to block up said electric terminals from the slots of said socket unit, or moved backwards to compress said spring elements upon the insertion of the metal contact blades of an electric plug into the slots of said socket unit, for permitting the metal contact blades of the inserted electric plug to make contact with the electric terminals of said socket unit, said safety baffle plate being tilted to force the top flange of one of said first top slopes into engagement with one recessed portion of said baffle holder and prohibited from backward movement when a rod member is inserted through one slot of said socket unit and pressed on one of said top slopes.

2. The safety socket and plug arrangement of claim 1 wherein said baffle holder is integrally molded on said socket unit on the inside.

3. The safety socket and plug arrangement of claim 1 wherein said socket unit is mounted in a hole in a mount having a recessed portion, and having a transverse hole which receives said baffle holder; said baffle holder is mounted in the transverse hole of said socket unit and supported on the recessed portion of said mount.

4. The safety socket and plug arrangement of claim 1 wherein said plug unit comprises a plug shell and a plug head, said plug shell comprising a circular open chamber at a back side thereof adapted for receiving said plug head, a plurality of locating grooves of different sizes spaced on the inside around said circular open chamber, a plurality of electric terminals, and a coupling portion disposed inside said circular open chamber, said plug head fitting said circular open chamber, comprising a plurality of metal contact blades adapted for connecting to an electric socket, a plurality of locating tabs of different sizes spaced around the periphery and adapted for fastening to the locating grooves of said plug shell through a rotary motion, and a coupling portion adapted for coupling to the coupling portion of said plug shell, the metal contact blades of said plug head being respectively forced into contact with the electric terminals of said plug shell when said plug head is installed in the plug hole of said plug shell.

5. The safety socket and plug arrangement of claim 1 wherein said plug unit comprises a plug shell and a plug head, said plug shell comprising a back recess extending to the border and adapted for receiving said plug head, two longitudinal sliding grooves at two opposite sides of said back recess, a plurality of electric terminals mounted in said back recess, a coupling portion, and a plurality of upright stub rods disposed in said back recess, said plug head comprising two sliding rails at two opposite sides adapted for inserting into the sliding grooves of said plug shell, a plurality of metal contact blades adapted for connecting to an electric socket, and a coupling portion adapted for coupling the coupling portion of said plug shell.

6. The safety socket and plug arrangement of claim 5 wherein said plug head further comprises two downward back troughs, two spring-supported baffle plates respectively mounted in said back troughs, and two coveres respectively covered on said back troughs, each of said covers having two downward sliding slots, and a bottom opening between said downward sliding slots, each of said spring-supported baffle plates having two bottom notches corresponding to the downward sliding slots of the corresponding cover, the stub rods of said plug shell being forced through the sliding slots of said covers into engagement with the bottom notches thereof when said plug head is installed in the back recess of said plug shell, causing the baffle plates of said plug head to be lifted upwards, for permitting the metal contact blades of said plug head to be forced into contact with the electric terminals of said plug shell.

7. The safety socket and plug arrangement of claim 5 wherein said plug head further comprises a downward back trough, a spring-supported baffle plate mounted in said donward back trough and having two bottom notches, and a cover covered on said downward back trough, said cover having two downward sliding slots and two bottom openings spaced between said downward sliding slots, the stub rods of said plug shell being forced through the sliding slots of the cover of said plug head into engagement with the bottom notches thereof when said plug head is installed in the back recess of said plug shell, causing the baffle plate of said plug head to be lifted upwards, for permitting the metal contact blades of said plug head to be forced into contact with the electric terminals of said plug shell.

8. The safety socket and plug arrangement of claim 1 wherein said plug unit comprises a plug shell and a plug head detachably fastened to said plug shell, said plug shell comprising a recessed back hole adapted for receiving said plug head, two longitudinal sliding grooves at two opposite sides of said recessed back hole, a plurality of electric terminals mounted in said recessed back hole, a coupling portion, pairs of vertically spaced notches respectively disposed in communication with said longitudinal sliding grooves, and a transverse locating groove connected between said longitudinal sliding grooves at a top side, said plug head comprising pairs of mounting tabs adapted for inserting through the notches of said plug shell into said longitudinal sliding grooves, a plurality of metal contact blades adapted for connecting to an electric socket, and a coupling portion adapted for coupling to the coupling portion of said plug shell, said plug head being pushed upwards into engagement with the transverse locating groove of said plug shell when the mounting tabs of said plug head are inserted through the notches of said plug shell into said longitudinal sliding grooves, thereby causing the coupling portion of said plug head to be forced into engagement with the coupling portion of said plug shell and the metal contact blades of said plug head to be forced into contact with the electric terminals of said plug shell.

9. The safety socket and plug arrangement of claim 5 wherein said plug shell is integrally molded in the shell of a transformer.

10. The safety socket and plug arrangement of claim 8 wherein said plug shell is integrally molded in the shell of a transformer.

* * * * *